US009130286B2

(12) United States Patent
Schlögl

(10) Patent No.: US 9,130,286 B2
(45) Date of Patent: Sep. 8, 2015

(54) PLUG-IN COUPLING

(75) Inventor: Gerhard Schlögl, Wernberg (DE)

(73) Assignee: HILDE SCHLÖGL, Wernberg (DE)

( * ) Notice: Subject to any disclaimer, the term of this patent is extended or adjusted under 35 U.S.C. 154(b) by 253 days.

(21) Appl. No.: 13/497,879

(22) PCT Filed: Aug. 17, 2010

(86) PCT No.: PCT/DE2010/000969

§ 371 (c)(1),
(2), (4) Date: Apr. 20, 2012

(87) PCT Pub. No.: WO2011/035756

PCT Pub. Date: Mar. 31, 2011

(65) Prior Publication Data

US 2012/0276766 A1 Nov. 1, 2012

(30) Foreign Application Priority Data

Sep. 23, 2009 (DE) ..... 10 2009 042 568

(51) Int. Cl.
*H01R 4/60* (2006.01)
*H01R 13/00* (2006.01)
*H01R 13/703* (2006.01)

(52) U.S. Cl.
CPC ..... *H01R 13/005* (2013.01); *H01R 13/7038* (2013.01); *H01R 2201/26* (2013.01)

(58) Field of Classification Search
CPC ..... H01R 13/7036; H01R 2103/00; H01R 13/005; E21B 17/028; H01L 23/473
USPC ..... 439/196, 188, 191, 194; 200/510.9, 200/51.09
See application file for complete search history.

(56) References Cited

U.S. PATENT DOCUMENTS

| | | | | |
|---|---|---|---|---|
| 3,649,949 | A * | 3/1972 | McCarthy et al. | 439/194 |
| 4,106,523 | A * | 8/1978 | Thornton et al. | 137/614.04 |
| 5,810,048 | A * | 9/1998 | Zeiner-Gundersen | 137/614.04 |
| 7,641,489 | B1 * | 1/2010 | Hsu et al. | 439/188 |
| 7,762,824 | B2 * | 7/2010 | Smith, III | 439/192 |
| 7,819,680 | B2 * | 10/2010 | Hoyack et al. | 439/188 |
| 7,931,484 | B2 * | 4/2011 | Chen | 439/188 |
| 8,517,749 | B2 * | 8/2013 | Marshall | 439/194 |
| 8,747,134 | B2 * | 6/2014 | Schlogl | 439/194 |
| 2002/0154461 | A1 | 10/2002 | Chapman | |
| 2005/0191867 | A1 * | 9/2005 | Birkenmaier et al. | 439/13 |
| 2007/0243730 | A1 * | 10/2007 | Gladd et al. | 439/98 |
| 2010/0099289 | A1 * | 4/2010 | Gemme et al. | 439/312 |
| 2010/0221940 | A1 * | 9/2010 | Hoyack et al. | 439/188 |
| 2010/0255698 | A1 * | 10/2010 | Chen | 439/152 |

FOREIGN PATENT DOCUMENTS

DE 199 16 984 7/2000

* cited by examiner

*Primary Examiner* — Thanh Tam Le
(74) *Attorney, Agent, or Firm* — Daniel A. Thomson; Emerson Thomson Bennett, LLC

(57) ABSTRACT

The invention relates to a plug-in coupling for the transfer of high-power energy and for the transfer of a fluid under pressure, consisting of at least one coupler plug (2) and at least one coupler socket (3). The coupler plug (2) can be introduced into the coupler socket (3) at least to some extent to produce a coupled state and can be removed from the coupler socket (3) to produce a decoupled state. The coupler socket (3) and the coupler plug (2) advantageously comprise an inner conductor (4, 5) which is electroconductive in at least some sections and which is surrounded by a fluid channel (6) in at least some sections. The coupler socket (3) and the coupler plug (2) have means (7, 8) for sealing the fluid channel (6) in a liquid-tight manner in the decoupled state and for producing a continuous fluid channel (6) in the coupled state.

20 Claims, 13 Drawing Sheets

PLUG-IN COUPLING

The invention relates to a plug-in coupling system according to the preamble of claim 1.

In motor vehicles, utility vehicles, construction and agricultural machinery, the transfer of high-power energy has been achieved in the past by means of hydraulic and/or mechanical concepts.

Increasingly there are attempts to use electric motors in the vehicle drive train and for driving auxiliary equipment, the electric power for which is supplied by a generator that is powered by a combustion motor. For this purpose it is necessary to provide the vehicle with an electric network for connecting numerous electric generators and consumers, such as generators, drives, power take-off components or electrically operated implements.

In order to transfer high-power energy in such an electric network it is advantageous to cool the electrical conductors by means of a liquid coolant, in order to minimize the conductor cross section necessary for a fixed power to be transferred.

Further, as an interface between the single electric generators and consumers, couplings are necessary that in addition to an electrical connection also establish a fluid connection for transmission of fluid in the respective cooling channels.

Such plug-in couplings transmit high-power energy in a range of 50 kW to 300 kW at an electric current of 50 A to 400 A. Upon interruption of a direct current circuit with such high-power, electric arcs can occur, which can endanger the operating personnel.

Based on this, the object of the invention is to present a plug-in coupling system that enables reliable disconnecting and connecting of high-power energy in a direct current circuit. This object is achieved based on the characteristics of the preamble of claim 1.

High-power energy according to this invention refers to a power range of 50 kW to 300 kW at an electric current of 50 A to 400 A.

The essential aspect of the plug-in coupling system according to the invention is that the plug-in coupling system comprises at least one electromechanical protection system consisting of at least one electronic switch means and at least one mechanical switch means, arranged inside the coupler socket and/or the coupler plug, said mechanical switch means establishing or separating the electroconductive connection, the electronic switch means and the mechanical switch means being independently controllable. The two-stage electromechanical protection system advantageously avoids over surges, in particular electric arcs, that occur during the disconnection and connection of high-power energy in a direct current circuit.

Also advantageously the at least one electronic switch means consists of a relay or an electronic circuit comprising at least one electronic high-power component, preferably a high-power transistor. The at least one mechanical switch means can be switched for establishing or separating the electrically conductive connection by introducing the coupler plug into the coupler socket or by removing the coupler plug from the coupler socket.

The coupler plug and the coupler socket further comprise an inner conductor surrounded by a fluid channel, the inner conductor of the coupler plug and of the coupler socket being at least to some extent surrounded by an electrically conductive contact sleeve that is embodied movably relative to the inner conductor and vice versa. The contact sleeve of the coupler plug is provided for electroconductively connecting the inner conductors of the coupler plug and of the coupler socket in the coupled state. Advantageously the inner conductor of the coupler socket is designed as having several parts, comprising at least two inner conductor elements that are connected with each other in an electrically insulated manner.

The at least two inner conductor elements advantageously are connected with each other by means of a pin of an electrically conductive material, preferably a ceramic pin, in which case an electrically conductive connection of the at least two inner conductor elements in the coupler socket in the coupled state is achieved by a movable contact sleeve, namely for example by means of at least one ring-shaped spring contact that is provided between the contact sleeve and the inner conductor.

Further embodiments, advantages and applications of the invention are also disclosed in the following description of exemplary embodiments and the drawings. All characteristics described and/or pictorially represented, alone or in any combination, are subject matter of the invention, regardless of their being summarized or referenced in the claims. The content of the claims is also an integral part of the description. The invention is illustrated in the drawings, where:

FIG. 13 *a, b* shows exemplarily a flow diagram for disconnecting and connecting a plug-in coupling system according to the invention.

Figure 1:
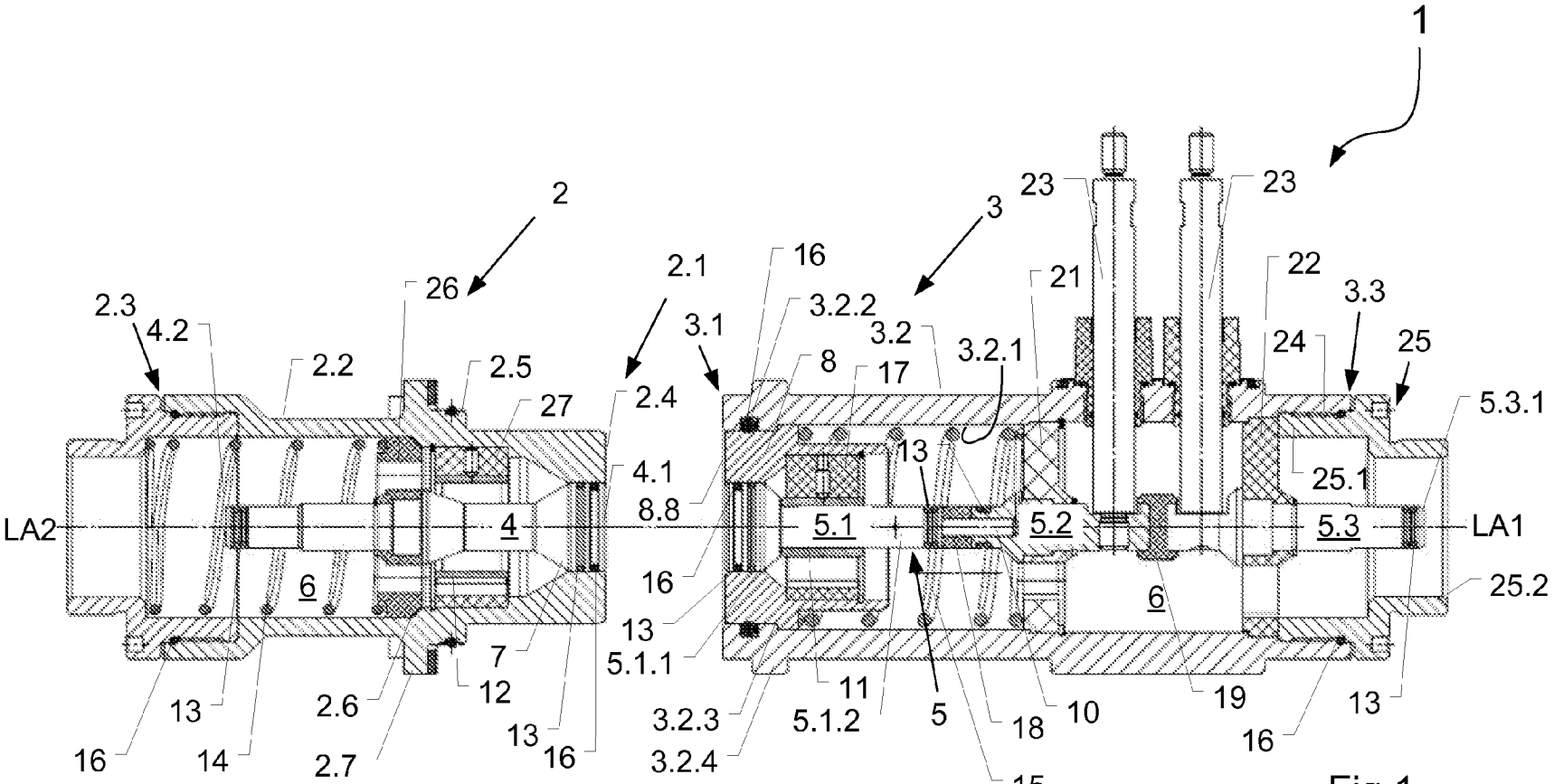
FIG. 1 shows exemplarily a plug-in coupling according to the invention in the decoupled state, in a side cross section view.
Figure 2:
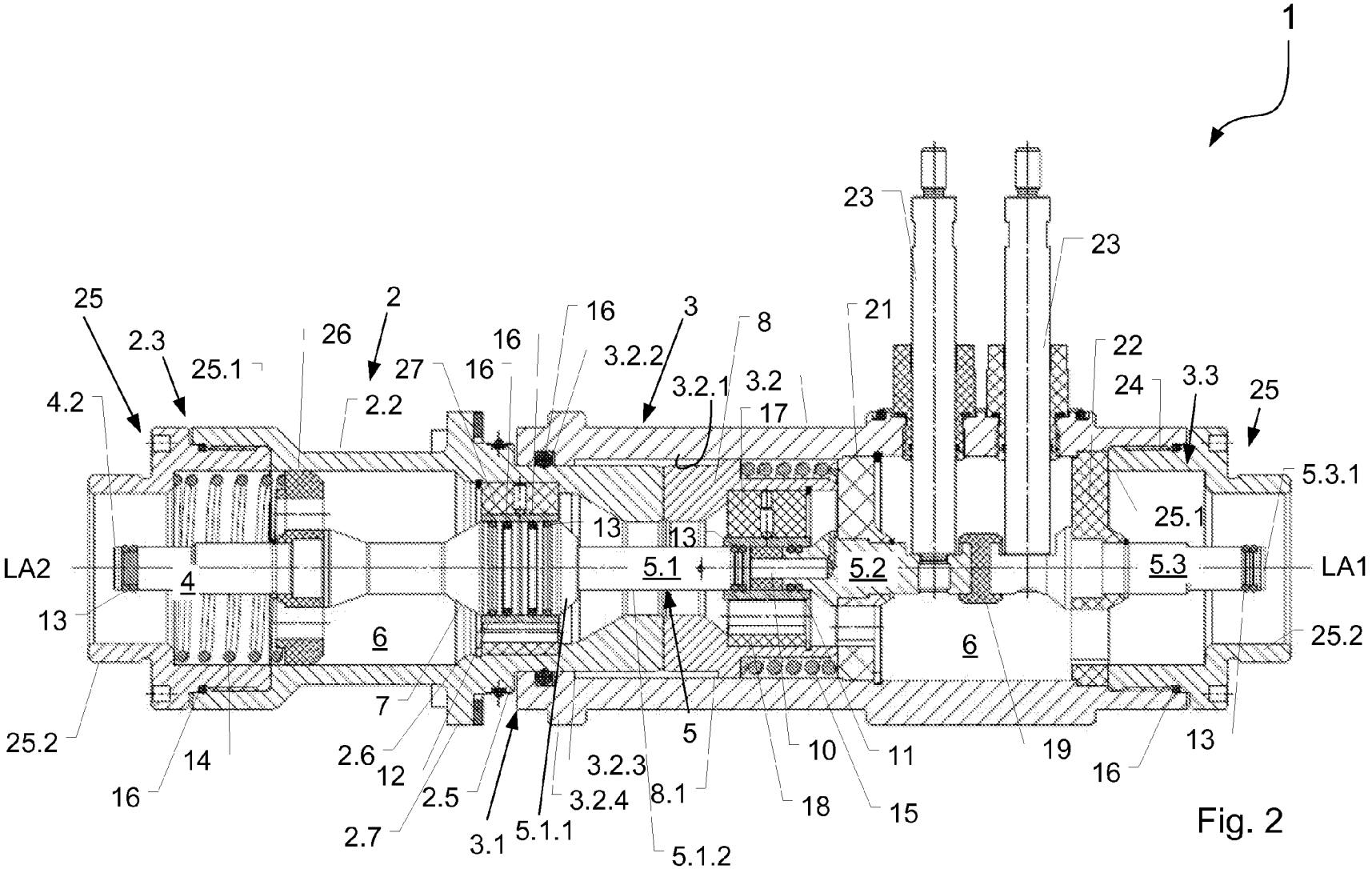
FIG. 2 shows exemplarily a plug-in coupling according to the invention in the coupled state, in a side cross section view.

FIG. 1 shows a plug-in coupling 1 according to the invention in the decoupled state and FIG. 2 shows the coupling in the coupled state, both in side cross section views.

The plug-in coupling 1, which is designed for the transfer of high-power energy and the simultaneous transfer of a pressurized fluid, in particular a cooling fluid, consists of at least one coupler plug 2 and at least one coupler socket 3, having one electroconductive inner conductor 4, 5, respectively. The coupler plug 2 can be introduced into the coupler socket 3 at least to some extent to produce a coupled state and can be removed from the coupler socket 3 to produce a decoupled state.

The plug-in coupling 1 depicted in the exemplary embodiment, which is intended for operation in a medium-voltage direct current system, for example with a power output of up to 300 kV and a current of 400 A, comprises at least one electromechanical protection system consisting of at least one electronic switch means 35 and at least one mechanical switch means 4, 11 provided within the coupler socket 3 and/or the coupler plug 2 for establishing or separating an electrically conductive connection. The electronic switch means 35 and the mechanical switch means 4, 11 preferably can be controlled or actuated separately from each other. This achieves a safety concept that offers maximum standards for operator safety.

The electroconductive inner conductors 4, 5 of the coupler socket 3 and of the coupler plug 2 are surrounded circumferentially by a fluid channel 6, which is designed for the flow of a pressurized fluid through the plug-in coupling 1. Further, one valve body 7, 8 is provided both in the coupler plug 2 and in the coupler socket 3, respectively, for sealing the fluid channel 6 in the decoupled state of the plug-in coupling 1.

The valve bodies 7, 8 can be moved within the coupler socket 3 and the coupler plug 2 and in the decoupled state are positioned by means of springs 14, 15, in particular coil springs, so that the coupler plug 2 and the coupler socket 3 are sealed in a liquid-tight manner by the valve body 7 and by the valve body 8 respectively on the coupler plug end 2.1 and on the coupler socket end 3.1, respectively.

During introduction of the coupler plug 2 in the coupler socket 3 the valve body 7 is moved within the coupler plug 2 and the valve body 8 is moved within the coupler socket 3 so that the plug-in coupling 1 comprises a continuous fluid channel 6 in the coupled state. The movement of the valve bodies 7, 8 not only produces a continuous fluid channel 6 through the plug-in coupling 1, but also an electrical connection between the inner conductors 4, 5 of the coupler plug 2 and of the coupler socket 3, namely due to the insertion and removal of the coupler plug 2 into and out of the coupler socket 3. The inner conductor 5 of the coupler socket 3 is designed as having several parts and preferably comprises one first through third inner conductor element 5.1 through 5.3.

Figure 3:
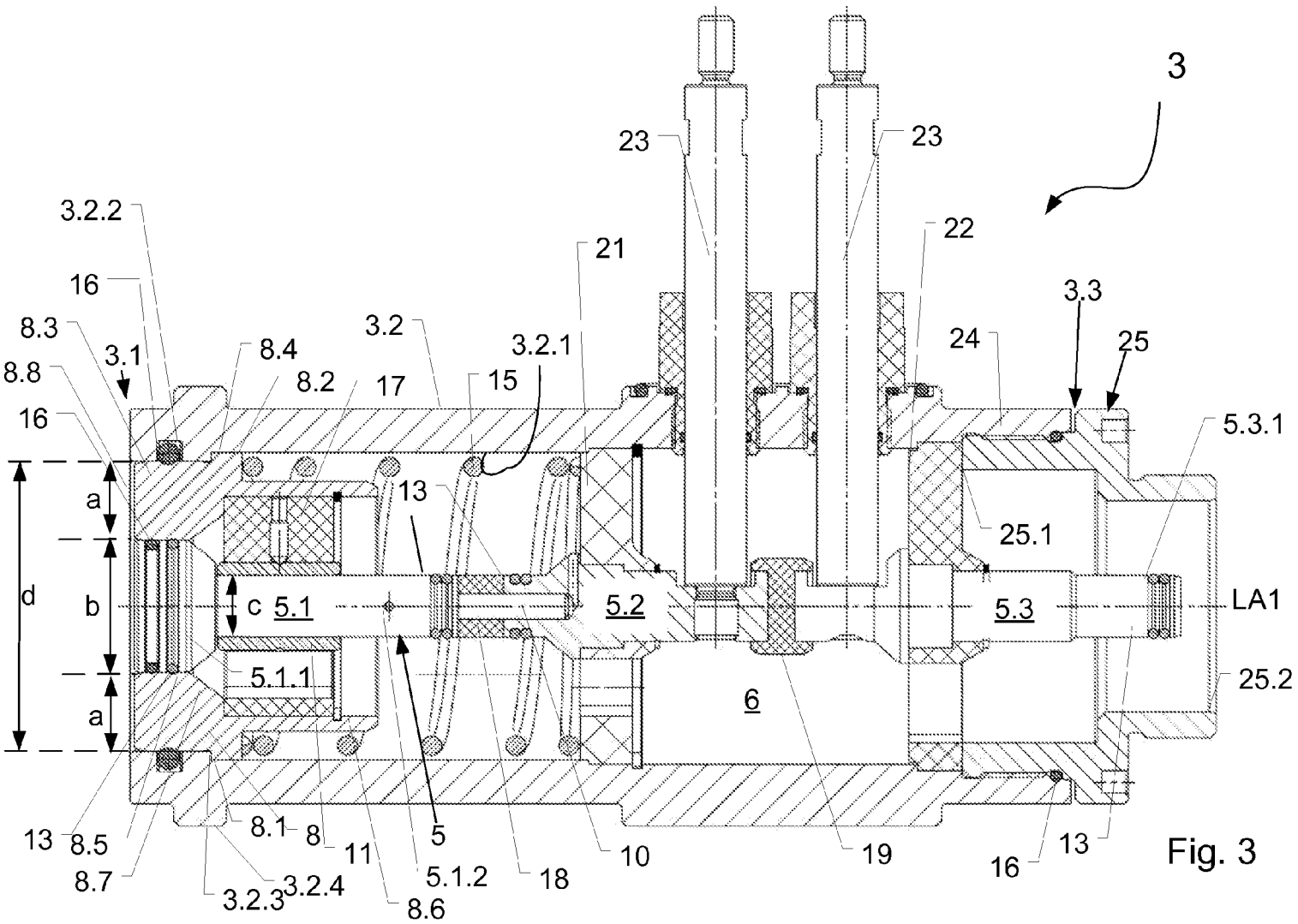
FIG. 3 shows exemplarily a coupler socket according to the invention in the decoupled state, in a side cross section view.

In the following, the design of the coupler socket 3 and of the coupler plug 2 is described exemplarily based on FIGS. 3 and 4.

The coupler socket 3 consists of an essentially round tube-shaped, electrically conductive, preferably metal coupler socket housing 3.2, which on the first coupler socket end 3.1 has a circular opening with the diameter d, which (opening) is sealed in a liquid-tight manner by the in front cross section circular ring-shaped valve body 8 having a circular opening with diameter b and the first inner conductor element 5.1 received in this valve body 8 with its thickened end 5.1.1.

Both the first inner conductor element 5.1 and the adjoining second and third inner conductor elements 5.2, 5.3 and the valve body 8 lie concentrically to the longitudinal axis LA1 of the coupler socket 3. The valve body 8 guided at least to some extent on the inner conductor 5 and surrounding the latter circumferentially is provided movably, namely along the longitudinal axis LA1, between the inner conductor 5 and the coupler socket housing 3.2. For liquid-tight sealing, the coupler socket housing 3.2 has on its inner side 3.2.1 in the area of the first coupler socket end 3.1 a groove 3.2.2 for receiving a seal 16; both the groove 3.2.2 and the seal 16 are preferably ring-shaped circumferentially around the valve body 8.

The valve body 8 has on its side facing the first inner side 3.2.1 of the coupler socket housing 3.2 for example one first and second gradation 8.1, 8.2, so that three sub-sections are formed on the outer circumferential side of the valve body 8, which preferably extend concentrically to the longitudinal axis LA1 of the coupler socket 3 and with a different radial clearance to this longitudinal axis LA1. The first gradation 8.1 is adapted to the gradation 3.2.3 of the inner side 3.2.1 of the coupler socket housing 3.2. The outer diameter d of the valve body 8 in the sub-section 8.3 of the valve body 8 is adapted to the diameter d of the opening of the coupler socket housing 3.2 on the first coupler socket end 3.1. This causes the seal 16 to seal the sub-section 8.3 of the valve body 8 circumferentially and seals the coupler socket 3 in a liquid-tight manner on this boundary surface.

The inner circumferential side of the valve body 8 facing the inner conductor 5 is likewise gradated, with a first inner side area 8.5 near the first coupler socket end 3.1 and a second inner side area 8.6 separated by a gradation 8.7 or a bevel. The first inner side area 8.5 and the second inner side area 8.6 extend concentrically to the longitudinal axis LA1, the first inner side area 8.5 having a smaller distance to the longitudinal axis LA1 than the second inner side area 8.6. The first inner side area 8.5 has a distance of approximately b/2 to the longitudinal axis LA1, so that the top area 5.1.1 of the first inner conductor element 5.1 having a diameter b, is received exactly in the inside of the valve body 8 in the decoupled state.

The first inner conductor element 5.1 of the coupler socket 3 is tapered in the end of the top area 5.1.1 facing away from the first inner conductor element 3.1 and changes into an inner conductor area 5.1.2 with a cylindrical form and an outer diameter c. The inner conductor area 5.1.2 is surrounded over a partial length by an electrically conductive, round tube-shaped contact sleeve 11, which is firmly connected with the valve body 8 in the second inner side area 8.6 by means of an electrically non-conductive insulating body 17, for example of plastic. The insulating body 17 preferably has several flow channels extending parallel to the longitudinal axis LA1 through which fluid flow is made possible in the coupled state of the plug-in coupling 1.

For electrical insulation of the first through third inner conductor elements 5.1, 5.2, 5.3 from each other they are separated from each other by insulating bodies 18, 19 and the first inner conductor element 5.1 is separated from the second inner conductor element 5.2 by a ceramic pin 10, which preferably is manufactured from zirconium oxide. On both sides of the insulating body 18 there is at least one, preferably on each side several spring contacts 13, namely in grooves, so that the spring contacts 13 circumferentially extending around the first and second inner conductor elements 5.1, 5.2 are partially recessed into the first and second inner conductor elements 5.1, 5.2. The contact sleeve 11 guided movably on the first inner conductor element 5.1, together with the first and second inner conductor elements 5.1, 5.2 and the spring contacts 13 provided preferably pair-wise on the mutually adjoining ends of the first and second inner conductor elements 5.1, 5.2, forms the mechanical switch means for establishing or separating the electrically conductive connection between the first and second inner conductor element 5.1, 5.2 of the coupler socket 3. The described mechanical structure ensures in the decoupled state of the plug-in coupling 1 the electrically insulated separation of the first and second inner conductor elements 5.1, 5.2 also during transfer of high-power energy and in the coupled state by movement of the contact sleeve 11 over the insulating body 18 and the thereon adjoining spring contacts 13 achieves an electric short circuit of the insulating body 18 and of the ceramic pin 10, so that the first and second inner conductor elements 5.1, 5.2 are connected electroconductively with each other.

For positionally correct fastening of the second inner conductor element 5.2 and of the connected first inner conductor element 5.1, an insulating disk 21, preferably manufactured from electrically insulating fiberglass-reinforced plastic, is provided within the coupler socket housing 3.2. The insulating disk 21 preferably has several flow channels extending along the longitudinal axis LA1 for producing a continuous fluid channel 6 through the coupler socket 3 in the coupled state of the plug-in coupling 1. The insulating disk 21 ensures the concentric alignment of the inner conductor elements 5.1, 5.2 within the coupler socket housing 3.2 and also secures the same against movement.

Due to the high electrical insulation of the insulating disk 21, the inner conductor 5, in particular the second inner conductor element 5.2, is galvanically separated from the electrically conductive coupler socket housing 3.2 which is preferably made of steel. Between the insulating disk 21 and the valve body 8, a pre-tensioned coiled spring 15, in particular a compression spring, is provided, preferably concentrically around and at a distance from the longitudinal axis LA1. This spring is supported in the bottom area on the side surface of the insulating disk 21 and in the top area on the second gradation 8.2 of the valve body 8, so that this valve body 8 in the decoupled state, i.e. with the coupler plug 2 being pulled out of the coupler socket 3, is pressed in the direction of the first coupler socket end 3.1 and due to the first gradation 8.1 of the valve body 8 that engages with the gradation 3.2.3 of the inner side 3.2.1 of the coupler socket housing 3.2, is exactly flush with the first coupler socket end 3.1. Upon introduction of the coupler plug 2 into the coupler socket 3 the valve body 8 is moved against the spring force of the spring 15 along the longitudinal axis LA1 of the coupler socket 3 within the latter, the valve body 8 being guided due to the contact sleeve 11 on the inner conductor area 5.1.2 of the first inner conductor element 5.1.

In the coupler socket 3 depicted in the exemplary embodiment, in a middle area that is limited on the side by the insulating disks 21, 22, approximately centered between said insulating disks 21, 22 and concentrically to the longitudinal axis LA1 there is an insulating body 19 that keeps the second and third inner conductor element 5.2, 5.3 apart and electrically insulates them from each other. Bore holes, into which pins 23 engage with their free ends, are provided in the second and third inner conductor element 5.2, 5.3, preferably at a right angle to the longitudinal axis LA1. These pins 23 are preferably designed as electrically conductive relay jumpers and lead approximately at a right angle from the coupler socket housing 3.2, the penetration points of the pins 23 through the coupler socket housing 3.2 being electrically insulated from the coupler socket housing 3.2 and designed in a liquid-tight manner.

By means of these pins 23 forming electrically conductive relay jumpers, the inner conductor 5 leads out of the coupler socket housing 3.2 so that a current flow through the coupler socket 3 is ensured only when the pins 23 serving for example as relay jumpers are bridged by means of an electronic switch means, preferably a relay 35, provided outside of the coupler socket housing 3.2. This relay 35 therefore forms the electronically controllable switch means for establishing or separating the electroconductive connection through the coupler socket 3. This forms the electrical part of the electromechanical protection system that in addition to existing mechanical safety devices enables electric current and voltage disconnection of the inner conductor 5 of the coupler socket 3.

Prior to disconnection of the plug-in coupling 1, i.e. prior to the changeover from the coupled state to the decoupled state, preferably first the relay 35 is switched, therefore disconnecting the electrically conductive connection between the second and third inner conductor element 5.2, 5.3. Afterwards, the mechanical switch means are actuated by pulling the coupler plug 2 out of the coupler socket 3, i.e. the contact sleeve 11 is pushed onto the first inner conductor element 5.1, therefore disconnecting the first inner conductor element 5.1 from the second inner conductor element 5.2. This ensures, in the event that for example the relay 35 fails or an emergency disconnection of the coupler plug 2 from the coupler socket 3 is necessary, by movement of the contact sleeve 11 that the inner conductor 5 in the area of the first coupler socket end 3.1 in the decoupled state is switched current-free and/or voltage-free.

Alternatively to the use of a relay 35 the at least one electronically controllable switch means can consist of at least one high-power component, preferably a high-power transistor, namely an electric and/or electronic switching circuit comprising an IGBT (insulated-gate bipolar transistor).

Figure 4:
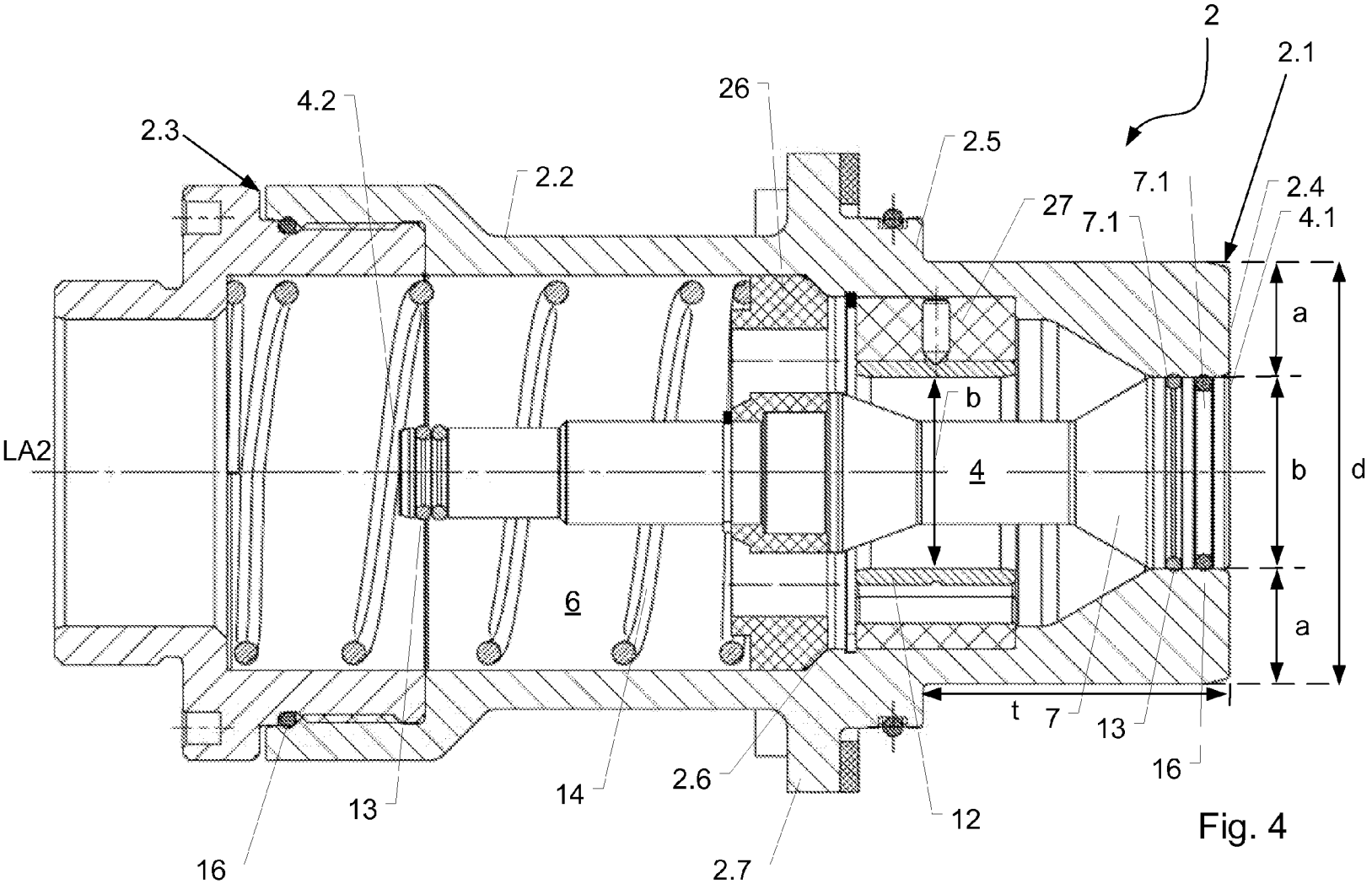
FIG. 4 shows exemplarily a coupler plug according to the invention in the decoupled state, in a side cross section view.

FIG. 4 shows a coupler plug 2 of the plug-in coupling 1 according to the invention in a side cross section view along its longitudinal axis LA2. The coupler plug 2 comprises an electroconductive, preferably metal coupler plug housing 2.2, which is designed as a hollow body with its inner and outer circumferential sides being essentially rotationally symmetrical to the longitudinal axis LA2. The first coupler plug end 2.1 of the coupler plug housing 2.2 is designed for introduction into the coupler socket 3 to produce the coupled state of the plug-in coupling 1. For this purpose the first coupler plug end 2.1 of the coupler plug housing 2.2 on the end side has a ring-shaped end face 2.4 with a ring thickness a. The circular geometry of the end face 2.4 has approximately the same dimensions as the end face 8.8 of the valve body 8, and upon introduction of the coupler plug 2 into the coupler socket 3, the end faces 2.4, 8.8 of the coupler plug housing 2.2 and of the valve body 8 bear against each other.

The first coupler plug end 2.1 has an essentially cylindrical outer form with a diameter d, which has the same dimensions as the opening of the coupler socket housing 3.2 on the first coupler socket end 3.1. The coupler plug housing 2.2 after a plug-in depth t (measured from the first coupler plug end 2.1) a gradation 2.5 that serves as an insertion limit of the coupler plug 2 into the coupler socket 3.

Inside the coupler plug 2 the inner conductor 4 is held movably, the movement of the inner conductor 4 positioned concentrically to the longitudinal axis LA2 taking place along this longitudinal axis LA2. The thickened, essentially cylindrical end of the inner conductor 4 located in the area of the first coupler plug end 2.1 forms a valve body 7 that is provided as a seal for the circular ring-shaped end face 2.4 of the coupler plug 2. The valve body 7 is dimensioned so that the opening of the circular end face 2.4 of the coupler plug 2 with the diameter b is precisely sealed by the valve body 7. The valve body 7 also comprises two grooves 7.1 extending circumferentially, which are provided for receiving a seal 16 and a spring contact 13. The seal 16 seals the end side opening of the coupler plug housing 2.2 in a liquid-tight manner by means of the valve body 7.

Guiding of the inner conductor 4 that is movable along the longitudinal axis LA2 and therefore also of the valve body 7 within the coupler plug housing 2.2 is achieved for example by means of an insulating disk 26 preferably of fiberglass-reinforced plastic, which preferably is permeated by several flow channels extending parallel to the longitudinal axis LA2. The insulating disk 26 has an inner bore hole preferably with at least one gradation and is pushed onto a gradated area of the same provided approximately centered on the inner conductor 4. The gradations of the insulating disk 26 and of the inner conductor 4 as well as of the inner bore hole of the insulating disc and the outer diameter of the inner conductor 4 are adapted to each other geometrically. The insulating disk 26 in the decoupled state of the plug-in coupling 1, spring-loaded by the spring 14, is pressed against a gradation 2.6 or bevel in the inside of the coupler plug housing 2.2. By means of the above-described gradations of the insulating disk 26 and the inner conductor 4, the spring force of the spring 14 is transferred to the inner conductor 4, thus causing the free end of the inner conductor 4 embodied as the valve body 7 to be held with its end side 4.1 flush with the end face 2.4 of the coupler plug housing 2.2, so that in the decoupled state the opening provided at this end face 2.4 is sealed in a liquid-tight manner by the valve body 7.

Upon introduction of the coupler plug 2 into the coupler socket 3 the inner conductor 4 and therefore also the valve body 7 is pushed along the longitudinal axis LA2 of the coupler plug 2 into the inside of the coupler plug housing 2.2, the valve body 7 being pushed back into the contact sleeve 12. This contact sleeve 12 is connected by means of an insulating body 27 in an electrically insulated manner with the coupler plug housing 2.2. It comprises at least one, preferably several flow channels, which enable the flow of a fluid along the longitudinal axis LA2. The contact sleeve 12 serves to electroconductively connect the top area 5.1.1 and the valve body 7 and therefore the inner conductors 4, 5 by means of the spring contact 13 in the coupled state of the plug-in coupling 1.

On the second coupler plug end 2.3 of the coupler plug housing 2.2 a reducing sleeve 25 is screwed in with its free end 25.1. This reducing sleeve 25 serves as a connection with a hose fitting of a liquid-cooled electrical conductor, and this hose fitting can be screwed onto the free end 25.2 of the reducing sleeve 25. The electrical connection between the free end 4.2 of the inner conductor 4 with the electrical conductor of a hose fitting screwed onto the free end 25.2 of the reducing sleeve 25 is achieved by means of spring contacts 13, which are provided in grooves, secured against movement, on the free end 4.2 of the inner conductor 4.

Upon introduction of the coupler plug 2 into the coupler socket 3 and the subsequent movement of the inner conductor 4, the free end 4.2 with the spring contacts 13 is pushed for example into a blind hole-like inner conductor end of the hose fitting, thus connecting the inner conductor 4 of the coupler plug 2 with the electrical conductor of the hose fitting by means of the spring contacts 13. This represents a mechanically actuated means for establishing and separating the electroconductive connection within the coupler plug 2. This makes it possible, in the case of masses that are coasting down in mounted implements, for example, and the voltage thereby induced, to prevent the transfer of this voltage to surfaces that can be touched by the operator.

In the following, in particular based on a synopsis of the plug-in coupling 1 as shown in FIGS. 1 and 2, the functional principal of the plug-in coupling 1 is explained.

The starting point for this is the decoupled state, as shown in FIG. 1. The special characteristic of the decoupled state of the plug-in coupling 1 is that the openings provided on the first coupler plug end 2.1 and on the first coupler socket end 3.1 are sealed in a liquid-tight manner by the valve bodies 7, 8 moved in a spring-loaded manner. Due to the movement of the valve body 7 and therefore the movement of the inner conductor 4 out of the conductor of a hose fitting screwed onto the reducing sleeve 25, the free end 4.2 of the inner conductor 4 of the coupler plug 2 is pulled out and therefore electrically disconnected.

In the coupler socket 3, in the decoupled state, the first and second inner conductor elements 5.1, 5.2 are electrically insulated from each other, since the contact sleeve 11, due to the spring loading of the valve body 8, is moved in the direction of the first coupler socket end 3.1, so that there is no electrical bridging of the insulating body 18 and of the ceramic pin 10 by means of this contact sleeve 11. To prevent electric charging of the exposed free ends of the inner conductor 4, 5 for example by capacitive or inductive effects, these ends are short-circuited in the decoupled state by means of spring contacts 13 to the coupler plug housing 2.2 and coupler socket housing 3.2.

For introduction of the coupler plug 2 into the coupler socket 3, the former is moved with its first coupler plug end 2.1 toward the coupler socket 3 so that the end face 2.4 of the coupler plug housing 2.2 comes to bear against the end face 8.8 of the valve body 8 and the end side 4.1 of the inner conductor 4 comes to bear against the end side of the top area 5.1.1 of the first inner conductor element 5.1. This causes the longitudinal axes LA1, LA2 of the coupler plug 2 and of the coupler socket 3 to be aligned congruently in one axis. Due to a pressure acting in the direction of the longitudinal axes LA1, LA2 on the coupler plug 2, the spring forces exerted by the springs 14, 15 are overcome, so that the valve body 8 and the inner conductor 4, which on its free end forms the valve body 7, are moved. The coupler plug 2 therefore enters with its first coupler plug end 2.1 the coupler socket 3 with plug-in depth t until the gradation 2.5 of the coupler plug 2 bears on the end side of the coupler socket housing 3.2, on the first coupler socket end 3.1.

The movement of the valve bodies 7, 8 during the plug-in process produces first a continuous fluid channel 6 and therefore a fluid connection in the plug-in coupling 1. Toward the end of the plug-in process the electrical connection is established, namely by means of the two-stage protection system according to the invention. Due to the movement of the valve body 8 within the coupler socket 3 the contact sleeve 11 is pushed over the insulating body 18 that electrically insulates the first and second inner conductor element 5.1, 5.2. By means of the spring contacts 13, which preferably are ring-shaped and preferably consist of a copper zirconium-chrome alloy, a highly conductive electrical connection is produced by the first inner conductor element 5.1 through the spring contacts 13 and the contact sleeve 11, with an electric load capacity of up to 300 kW at an electric current of up to 400 A. The same requirements apply likewise for all other contact points of the plug-in coupling 1.

During the plug-in process the first inner conductor element 5.1 is exposed at least to some extent, in particular in the top area 5.1.1 as a result of the valve body 8 being pushed back within the coupler socket 3. By insertion of the first coupler plug end 2.1 this exposed top area 5.1.1 and at least to some extent the adjoining inner conductor area 5.1.2 enters the inner space of the coupler plug housing 2.2 freed by the valve body 7 and the inner conductor 4. This causes the end side of the top area 5.1.1 and the end side 4.1 of the inner conductor 4 to bear against each other.

In the coupled state of the plug-in coupling 1 the valve body 7 of the coupler plug 2 and the top area 5.1.1 of the first inner conductor element 5.1 of the coupler socket 3 lie in the area of the contact sleeve 12 and are surrounded in a form-fit manner by the latter. Due to the spring contacts 13 provided on the valve body 7 and the top area 5.1.1 the inner conductor 4 is electrically connected by the contact sleeve 12 with the first inner conductor element 5.1 of the inner conductor 5. By means of the contact sleeves 11, 12 in the coupled state electrical conductivity of the inner conductor 4 of the coupler plug is produced by the first inner conductor element 5.1 to the second inner conductor element 5.2 of the coupler socket.

Figure 5:
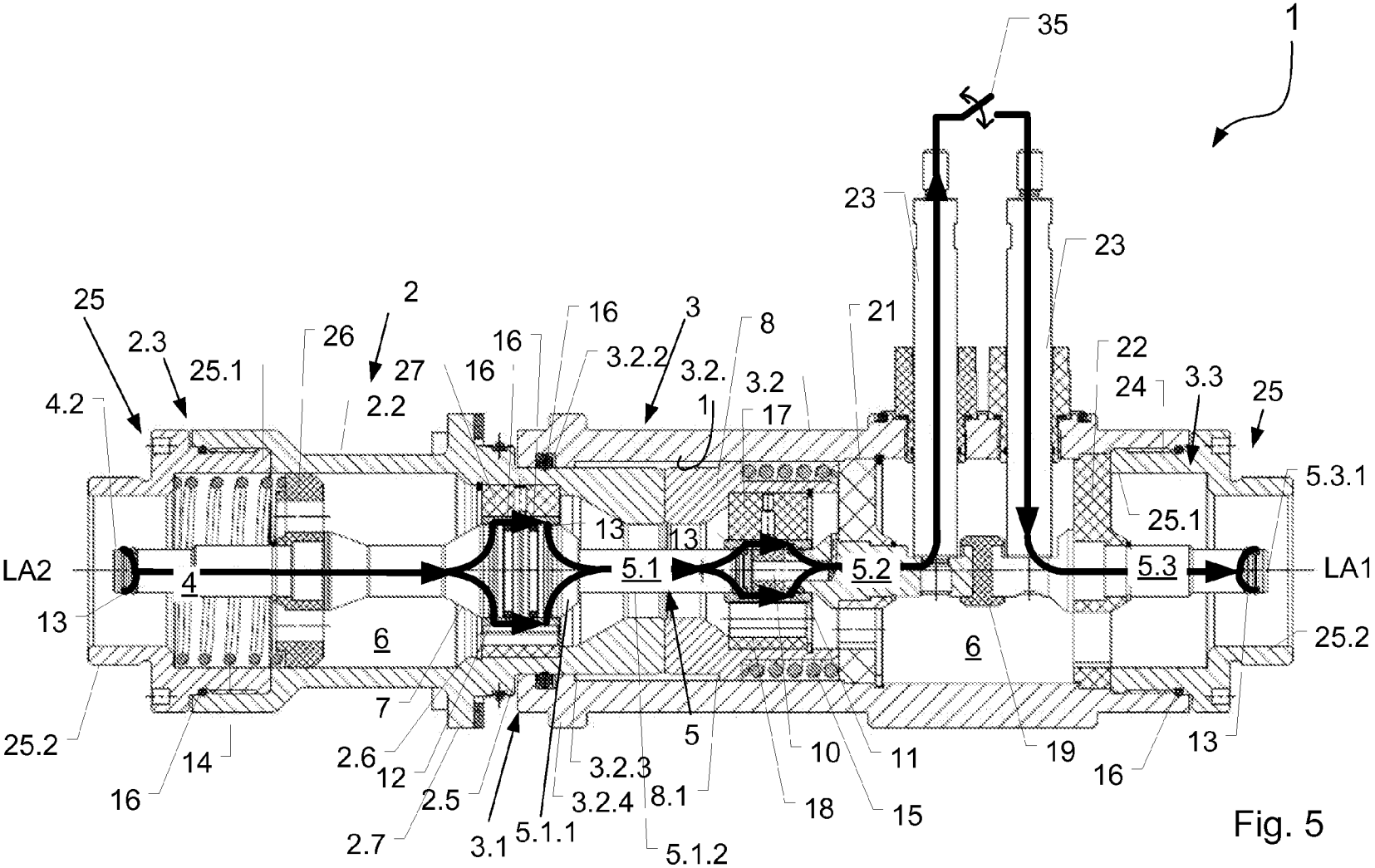
FIG. 5 shows exemplarily and schematically the electric current flow through a plug-in coupling according to the invention.

In the event that the pins 23 leading out of the coupler socket housing 3.2 are short circuited outside of the plug-in coupling 1, for example by means of a relay 35, continuous electrical conductivity of the plug-in coupling 1 is achieved as depicted by means of arrows in FIG. 5.

In addition to producing the electrical conductivity between the inner conductors 4, 5 of the coupler plug 2 and of the coupler socket 3, the liquid-tight seal produced upon introduction of the coupler plugs 2 into the coupler socket 3 must be canceled and a low-loss continuous fluid channel 6 through the plug-in coupling 1 must be established. As already explained, the fluidic coupling of the coupler plug 2 with the coupler socket 3 takes place immediately before establishing an electroconductive connection. In the decoupled state the valve bodies 7, 8 seal the coupler plug 2 and the coupler socket 3 in a liquid-tight manner.

Upon introduction of the coupler plug 2 into the coupler socket 3 and the movement described above of the inner conductor 4 and of the valve body 7 and the valve body 8 against the spring force of the springs 14, 15, the openings sealed by the valve bodies 7, 8 are exposed at least to some extent, enabling a fluid flow over the limit surface defined by the end side 2.4. Due to the fact that the fluid is preferably an insulating oil, which due to its insulating properties suppresses electric arcs that could occur during the coupling and decoupling process, it is advantageous that the fluid flow during the coupling process takes place prior to, and during the decoupling process following the electrical connection or separation of the inner conductors 4, 5.

Figure 6:
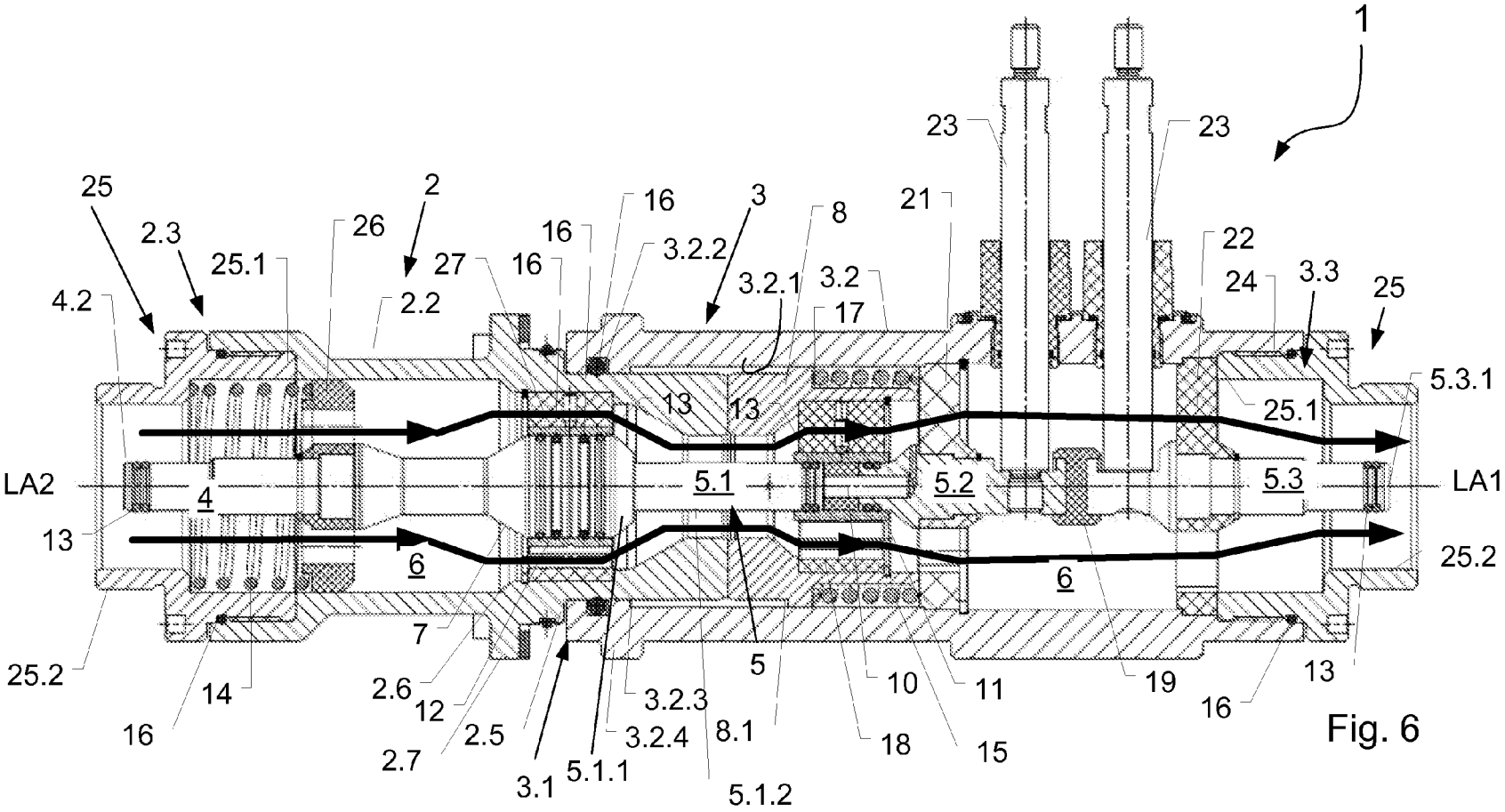
FIG. 6 shows exemplarily and schematically the fluid flow through a plug-in coupling according to the invention.

FIG. 6 shows the path of the fluid while flowing through the plug-in coupling 1. Due to the essentially rotationally symmetric design of the plug-in coupling 1 around the longitudinal axis LA, a fluid channel 6 is produced that completely surrounds the inner conductors 4, 5 on the circumferential side. At points where the inner conductors 4, 5 are supported against the coupler plug housing 2.2 and the coupler socket housing 3.2, the supporting element, i.e. the insulating disks 21, 22, 26 and the insulating bodies 17, 27 are permeated by flow channels, which are dimensioned to enable a virtually loss-free flow of the fluid through the plug-in coupling 1. Of course, the direction of flow can also be in the opposite direction.

The valve body 7 and the top area 5.1.1 of the first inner conductor element 5.1 are of special significance for two reasons. Firstly, these elements, with their seals 16 extending along their circumference, provide a liquid-tight seal of the coupler plug 2 and of the coupler socket 3 in the decoupled state. Secondly, the electrical connection between the inner conductor 4 and the inner conductor 5 in the coupled state is achieved by the spring contacts 13 provided respectively on the valve body 7 and on the top area 5.1.1 of the first inner conductor element 5.1, which (spring contacts) lie on the respective elements next to the seals 16 described above. To achieve both an optimal liquid-tight seal in the decoupled state and a highly conductive electrical connection by means of the contact sleeve 12 in the coupled state, it is necessary that both the spring contacts 13 and the seal 16 have approximately the same geometric shapes and outer dimensions. In addition, the spring contact 13 must be elastically deformable so that it can be inserted into the contact sleeve 12 without jamming and also allows movement of the valve bodies 7, 8 without jamming, as a result of the spring forces of the springs 14, 15 alone.

Figure 7:
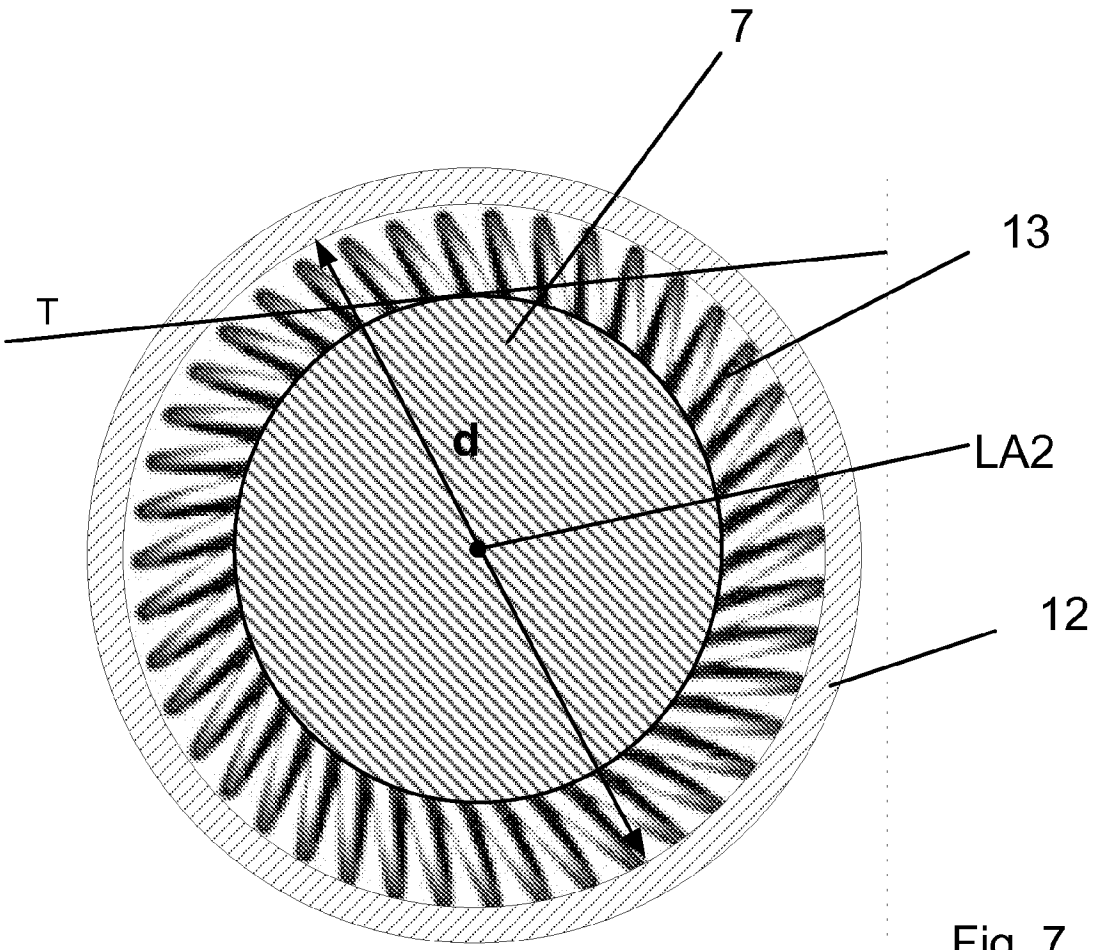
FIG. 7 shows exemplarily the electric contact of the inner conductor via the contact sleeve by means of the spring contacts.

FIG. 7 shows the contacting between the valve body 7 and the contact sleeve 12 in a cross section view perpendicular to the longitudinal axis LA2. As a result of the circumferential spiral design of the spring contact 13 around the valve body 7, the latter can be inserted for example into the contact sleeve 12 or into the opening of the coupler plug housing 2.2 provided on the first coupler plug end 2.1, and its diameter b can be designed to be slightly smaller, so that the spring contact 13 there is deformed in such a manner that the single coils of the spring contacts 13 occupy a smaller angle to the tangent T on the valve body 7 than is the case prior to deformation.

Figure 8:
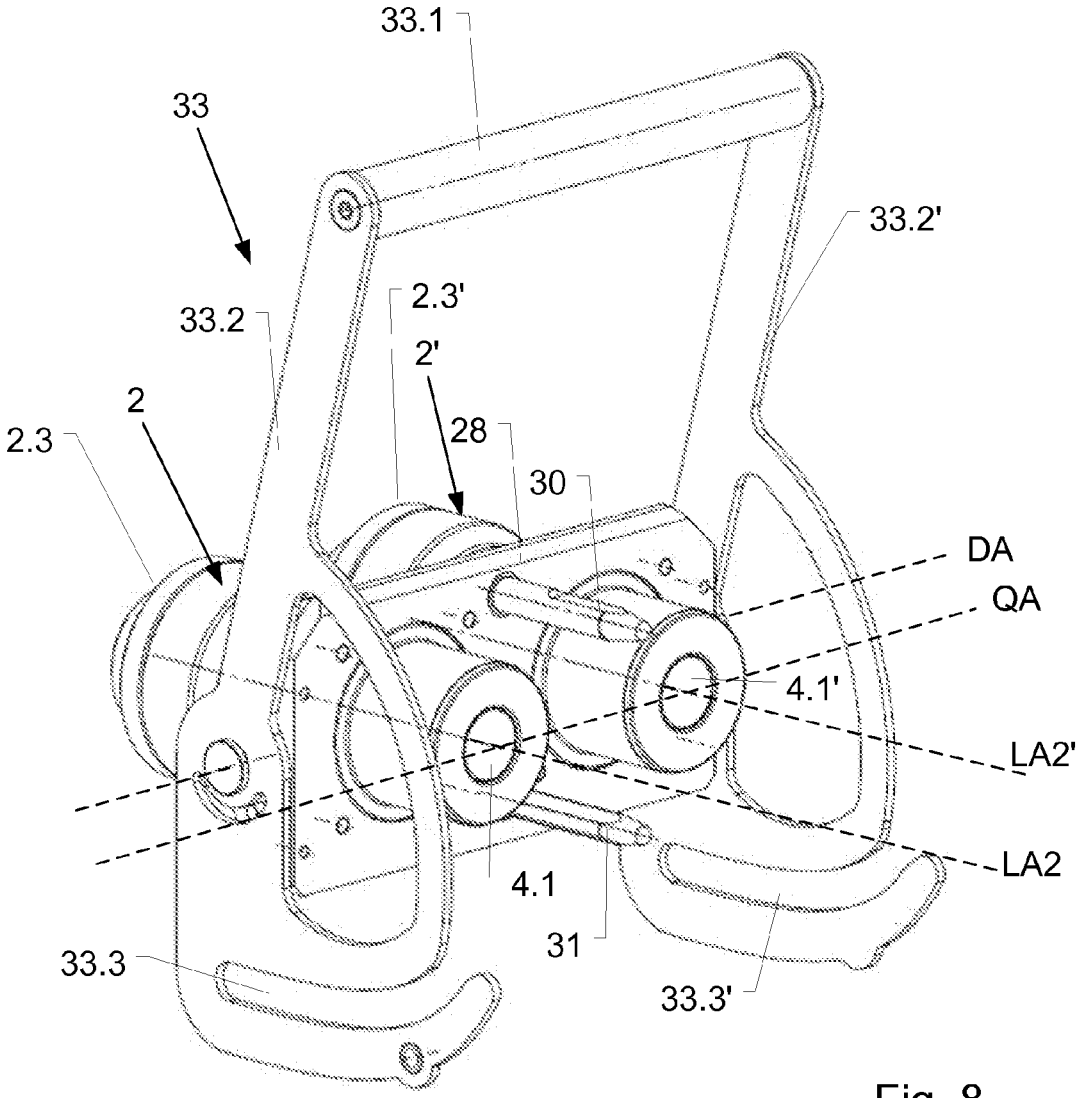
FIG. 8 shows exemplarily the arrangement of two coupler plugs on a coupler plug plate, in a perspective view.
Figure 9:
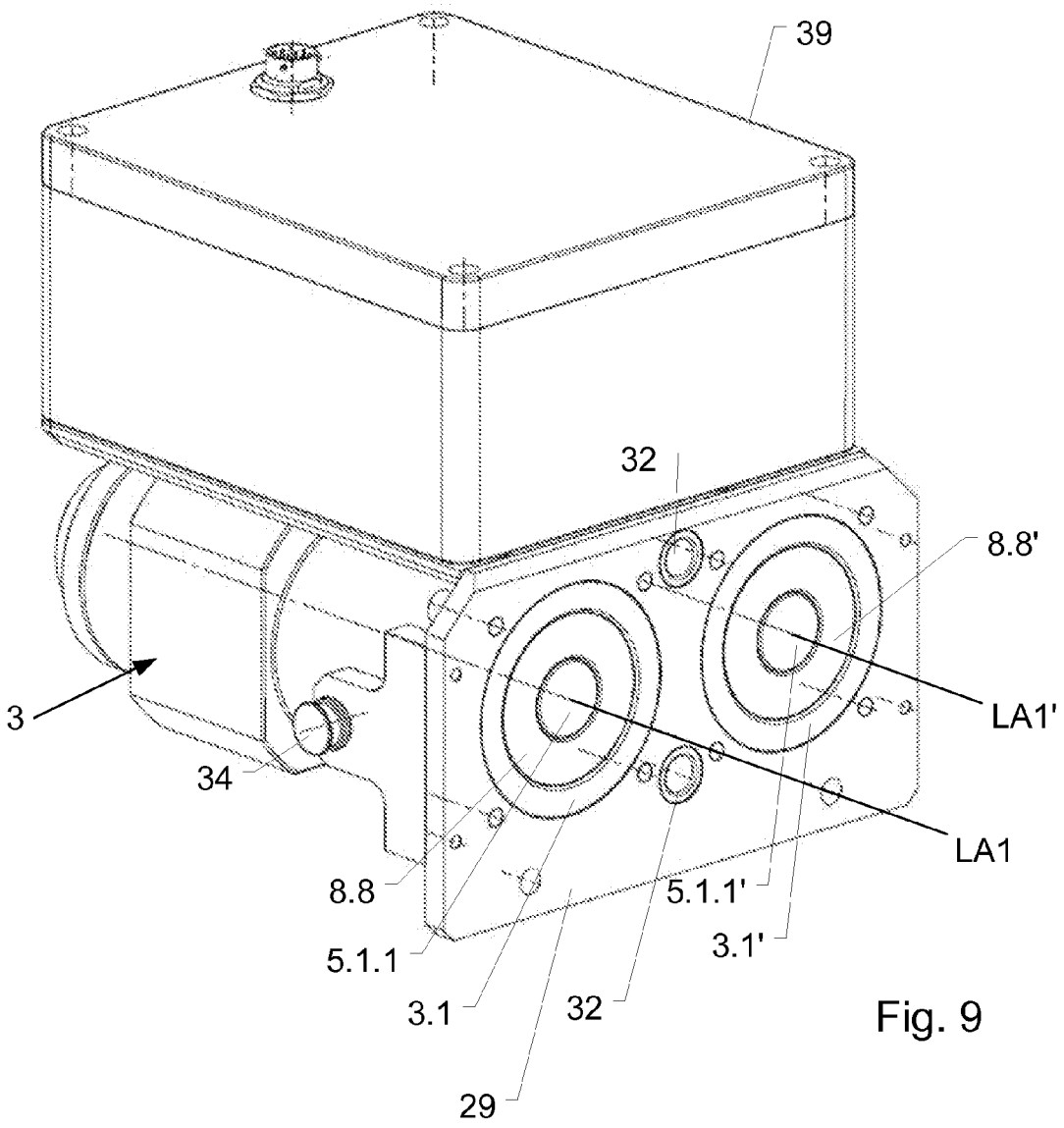
FIG. 9 shows exemplarily the arrangement of two coupler sockets on a coupler socket plate, in a perspective view.

The plug-in coupling 1, which for example has an electric load capacity of up to 300 kW at an electric current of up to 400 A and preferably is designed for the transfer of direct current and direct voltage, is preferably, as shown in FIGS. 8 and 9, arranged in pairs, in which case two coupler plugs 2, 2' are arranged at a distance next to each other by means of one coupler plug plate 28, so that the center points of the circular end sides of the coupler plugs 2, 2' are received in the transverse axis QA extending perpendicular to the longitudinal axes LA2, LA2'. The coupler plugs 2, 2' enter with their first coupler plug ends 2.1, 2.1' the coupler plug plate 28 in round circular openings, the coupler plugs 2, 2' being brought to bear with their end faces of the flange 2.7 facing the first coupler plug ends 2.1, 2.1' on the back side against the coupler plug plate 28 and preferably are screwed to the latter. The pair-wise arrangement of two coupler plugs 2, 2' on the coupler plug plate 28 also enables a connection of two coupler plugs 2, 2' with two coupler sockets 3, 3', so that a closed electric circuit and a fluid circuit consisting of forward and return lines can be achieved in a single coupling process.

Likewise, an arrangement of two coupler sockets 3, 3' on one coupler socket plate 29 is provided, the single coupler sockets 3, 3' being arranged by means of the flange 3.2.4 on the coupler socket plate 29. The coupler sockets 3, 3' enter with their first coupler socket end 3.1, 3.1' the coupler socket plate 29 preferably with an exact fit at circular openings, in which case the coupler socket plate 29 comes to bear on the end side of the flange 3.2.4 facing the first coupler socket end 3.1, 3.1' and preferably being exactly flush with the first coupler socket end 3.1, 3.1', i.e. essentially forming one plane with the latter.

To enable a coupling process without jamming, it is necessary to align the coupler plugs 2, 2' to the coupler sockets 3, 3', so that the coupler plugs 2, 2' can easily be inserted into the coupler sockets 3, 3'. For this purpose the coupler plug plate 28 is provided with a centering pin 30 and a troche 31, which protrude perpendicularly from the coupler plug plate 28 and parallel to the longitudinal axes LA2, LA2'. The centering pin 30 and the troche 31 are arranged in the center between the two coupler plugs 2, 2' and offset to the transverse axis QA. The centering pin 30 serves during introduction of the coupler plug 2, 2' into the coupler socket 3, 3' to center these elements in relation to each other, i.e. the centering pin 30 limits the movement of the coupler plug 2, 2' in the horizontal and vertical direction of movement. The troche 31, which preferably is prism-shaped on the circumferential side for compensation of production tolerances, is provided to avoid rotation around the centering pin 30. The centering pin 30 and the troche 31 cooperate on the coupler socket plate 29 with flange sleeves 32 and are inserted into these flange sleeves 32 during the coupling process.

To achieve a releasable, secure mechanical locking of the coupler plug 2, 2' and the coupler socket 3, 3', a crescent lever 33 is provided on the coupler plug plate 28, which (lever) cooperates with pins 34 that are connected with the coupler socket plate 29. The crescent lever 33 is bow-shaped and a grip 33.1 connects two crescent lever halves 33.2, 33.2' located on the side of the coupler plug plate 28 with each other. The crescent lever halves 33.2, 33.2' are mounted rotatably around a rotation axis DA extending perpendicular to the longitudinal axis LA2, LA2' of the coupler plug 2, 2' and parallel to the transverse axis QA and each one has a crescent-shaped recess 33.3, 33.3'.

These recesses 33.3, 33.3' are designed to receive pins 34 mounted on the coupler plug plate 29. To lock the plug-in couplings 1, 1' first the centering pin 30 and the troche 31 are moved toward the flange sleeves 32 and inserted into the latter and then the pins 34 are engaged with the recesses 33.3, 33.3' of the crescent lever 33. By swiveling the crescent lever 33 in such a manner that the grip 33.1 is swiveled in the direction of the second coupler plug ends 2.3, 2.3' the pins 34 slide into the recesses 33.3, 33.3', namely in such a manner that their radius relative to the rotation axis DA becomes smaller toward the closed recess end. As a result, the coupler plugs 2, 2' are guided increasingly toward the coupler sockets 3, 3' by swiveling of the crescent lever 33. The coupled state of the plug-in couplings 1, 1' is achieved when the pins 34 reach the ends of the recesses 33.3, 33.3' and the coupler plug plate 28 and the coupler socket plate 29 come to bear against each other. Release of the plug-in couplings 1, 1' is achieved by pressing the crescent lever 33 in the opposite direction.

The fluid used in the plug-in coupling 1 according to the invention preferably is an insulating oil with very good electrical insulating properties, therefore ensuring electric insulation of the inner conductors 4, 5 from the coupler plug housing 2.2 and the coupler socket housing 3.2 in the areas of the fluid channels 6. The coupler plug housing 2.2 and the coupler socket housing 3.2 are connected respectively with the chassis ground, i.e. for example with the ground of the vehicle or the mounted implement, so that in the coupled state they are electrically connected by these grounds and therefore have the same voltage. In addition to electrical insulation the insulating oil also serves to thermally cool the inner conductors 4, 5 of the plug-in coupling 1, the insulating oil being forced with pressures of up to 20 MPa, preferably pressures of less than 6 MPa, through the plug-in coupling 1 in the coupled state. The plug-in coupling 1 is designed for a maximum flow rate of the insulating oil of 3 m per second at a volume flow of 120 cubic decimeters per minute. In addition to insulation and cooling, the insulating oil also performs the task of suppressing electric arcs that can occur during the coupling and decoupling process.

In the following, in FIG. 10, the overall safety concept in which the electromechanical protection system of the plug-in coupling systems 1 according to the invention is integrated, is described in more detail.

Figure 10:
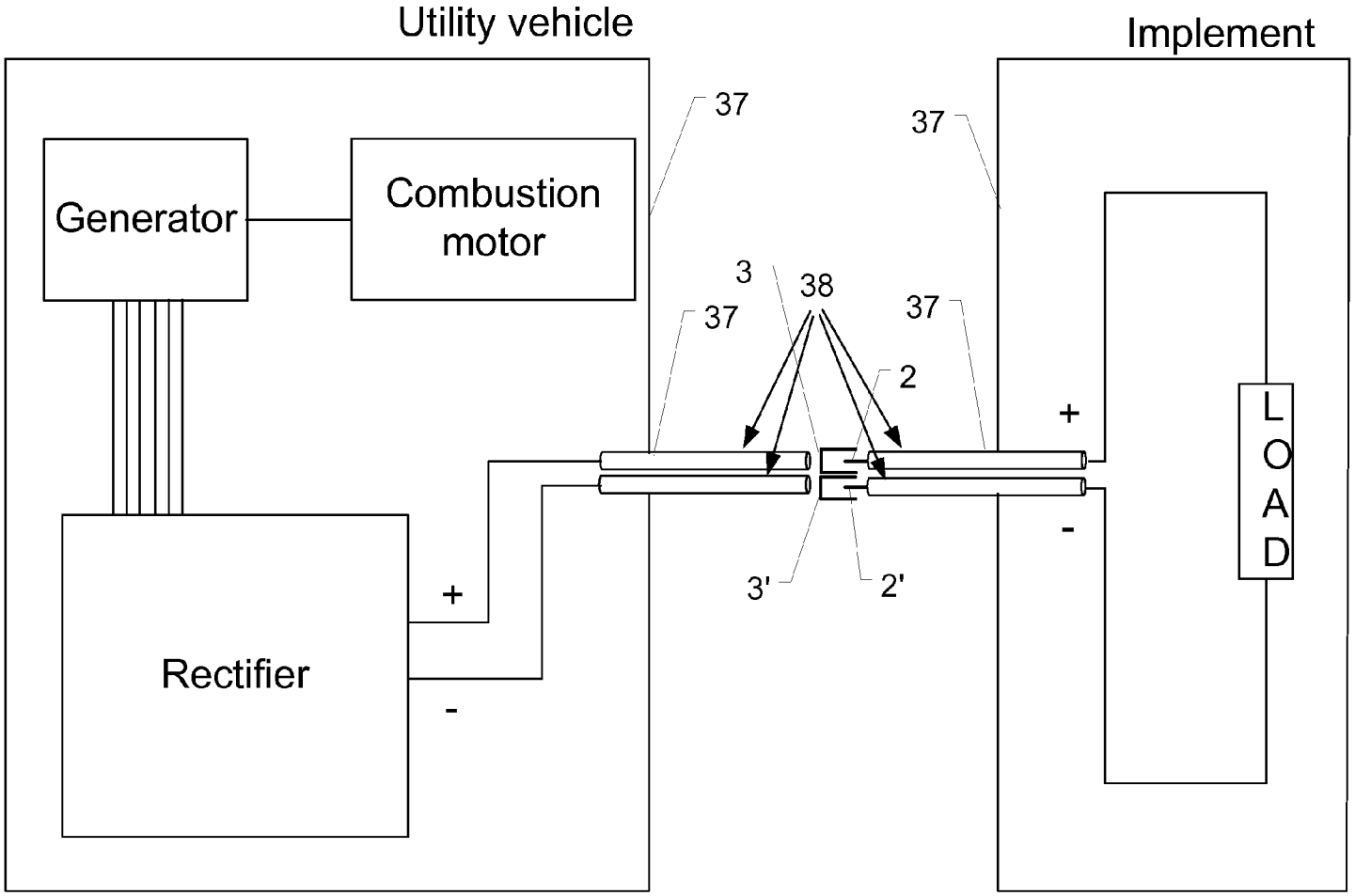
FIG. 10 shows exemplarily a schematic view of a utility vehicle with an implement attached by a plug-in coupling system according to the invention.

FIG. 10 shows in a schematic depiction a utility vehicle, for example a tractor, with a mounted implement, the electrical and fluidic coupling between the utility vehicle and the implement being established by means of two plug-in couplings 1 according to the invention. This schematic depiction shows only the electrical network without the fluid circuit, for reasons of clarity.

The utility vehicle comprises a combustion motor whose mechanical power is used to drive a generator. The alternating voltage or the alternating current generated by the generator is converted by a rectifier to direct voltage or direct current, which is provided for establishing a direct voltage network. This direct voltage network is used to drive both the utility vehicle itself and the auxiliary equipment and mounted implements.

All voltage- and current-carrying elements are surrounded by an electrically conductive, preferably metal protective sheath 37 that is insulated from the voltage- and current-carrying elements. The protective sheath 37 consists in the area of the hose lines 38 of a metallic fabric in the hose wall and in the area of the plug-in coupling 1 of the coupler plug housing 2.2 and coupler socket housing 3.2. The protective sheath 37 surrounding all voltage- and current-carrying elements creates highly effective shielding against electromagnetic radiation, or electromagnetic compatibility, so that interference with sensitive electric components located in the vicinity of the voltage- and current-carrying parts is substantially reduced in case of higher voltage or current fluctuations.

A resistant measurement can be used to check for example the insulation between the voltage- or current-carrying elements and the protective sheath 37, so that in case of decreasing or non-existent insulation suitable safety measures can be initiated, such as the output of an error message or an emergency shut-down.

A bus system, preferably a CAN bus ("Controller Area Network Bus") is provided for monitoring and control of all electronic system components located in the area of the utility vehicle and the mounted implement. In the area of the plug-in coupling 1 this bus system is used both for monitoring the current coupling state, securing the plug-in coupling 1 against improper disconnection during the flow of current through the plug-in coupling 1 and also for controlling the electronic switch means, in particular the relay 35, for establishing or separating the electrically conductive connection.

Figure 11:
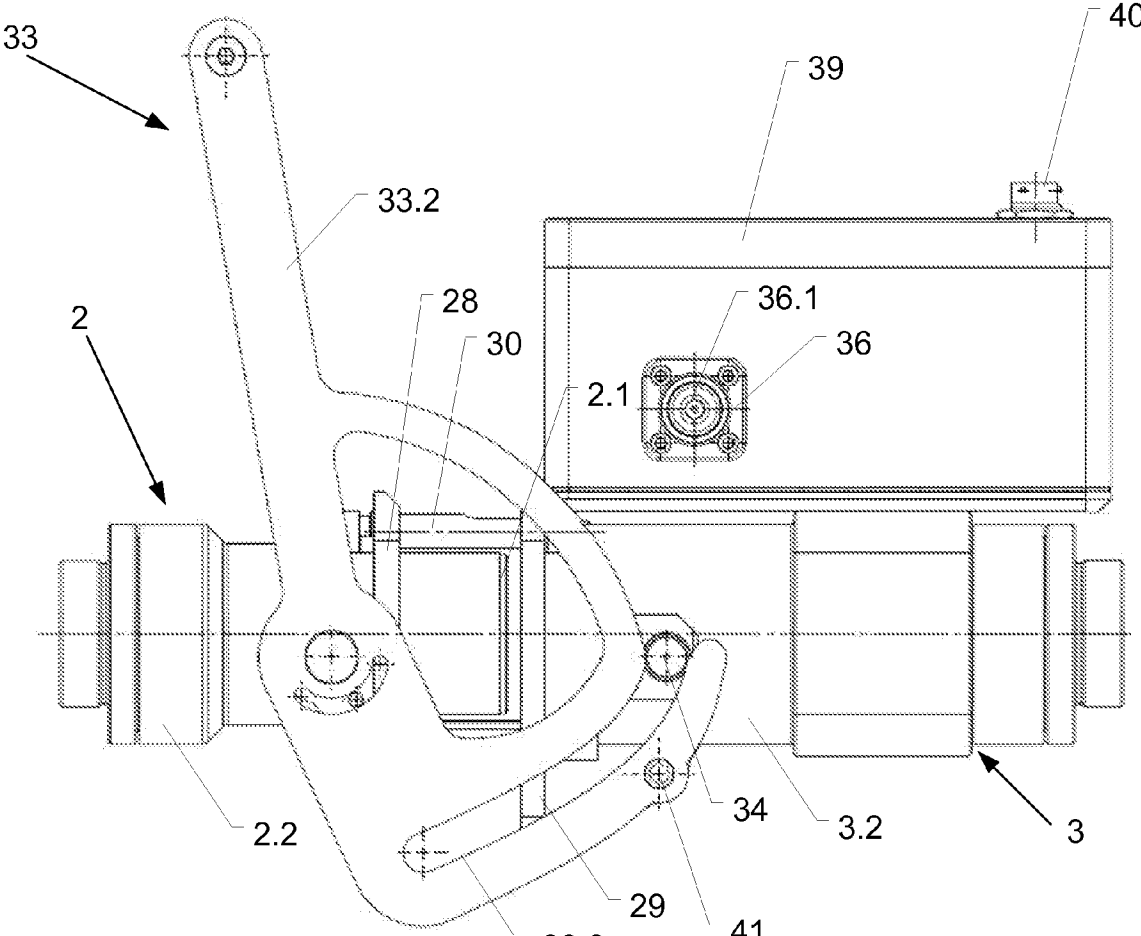
FIG. 11 shows exemplarily a plug-in coupling system according to the invention in the decoupled state, in a side view.
Figure 12:
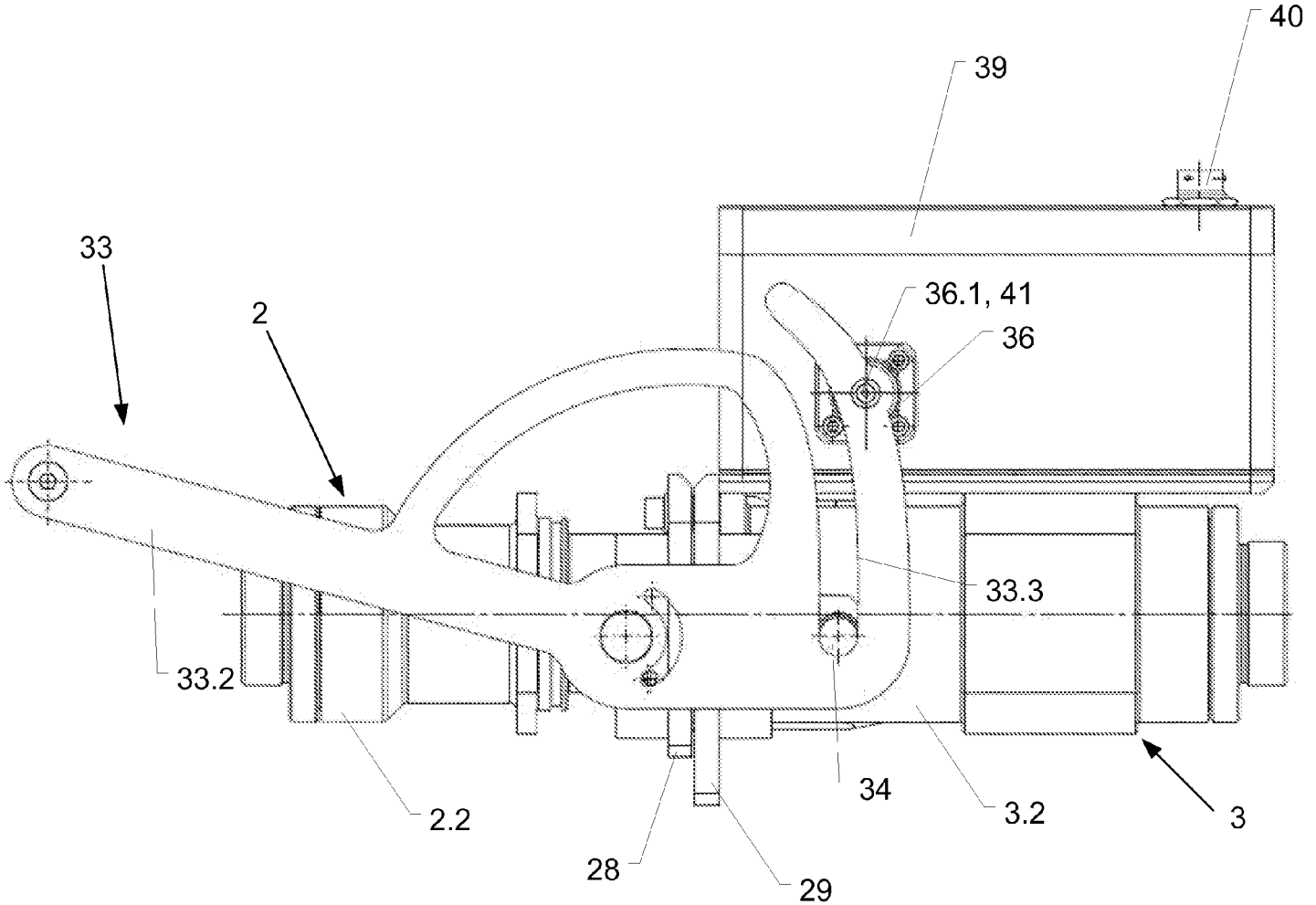
FIG. 12 shows exemplarily a plug-in coupling system according to the invention in the coupled state, in a side view.

As depicted in FIGS. 10 and 11, an electronics box 39 comprising a connection 40 for the bus system is provided above the coupler sockets 3, 3'. This electronics box 39, into which the pins 23 protruding from the coupler sockets 3, 3' lead, contains in addition to the relay 35 for the electrical connection of these pins 23, a solenoid 36 with a locking pin 36.1 that cooperates through the side wall of the electronics box 39 with a bore hole 41 or bush in the crescent lever 33 in the coupled state. The solenoid 36 can be controlled via the bus system in such a manner that in the coupled state during the transfer of electric power through the plug-in coupling 1, the crescent lever 33 is secured by the locking pin 36.1 against swiveling, therefore securing the plug-in coupling 1 against improper disconnection. The swiveling of the crescent lever 33 is prevented by the fact that the locking pin 36.1 of the solenoid 36 engages in the bore hole 41 of the crescent lever 33 (FIG. 12).

For disconnecting the plug-in coupling 1 the solenoid 36 is controlled via the bus system in the manner that the locking pin 36.1 is retracted at least to some extent into the electronics box 39, so that its engagement in the bore hole 41 is released and the crescent lever 33 can be swiveled to disconnect the plug-in coupling 1.

In a preferred embodiment at least one first proximity sensor is provided for determining the coupling state of the plug-in coupling 1. This first proximity sensor detects the distance of the coupler plug 2, 2' from the coupler socket 3, 3', in particular through the insertion state of the centering pin 30 into the flange sleeve 32. Preferably a second proximity sensor is provided that detects the position of the locking pin 36.1 of the solenoid 36. It goes without saying that additional proximity sensors for monitoring states can be used, for example an angle sensor for detecting the swivel state of the crescent lever 33. These proximity sensors make it possible to check, via the bus system, the coupling state of the plug-in coupling 1 and in particular also the locking of the same by means of the crescent lever 33 and based on the values measured by the proximity sensors, to initiate or block particular processes.

Figure 13B:
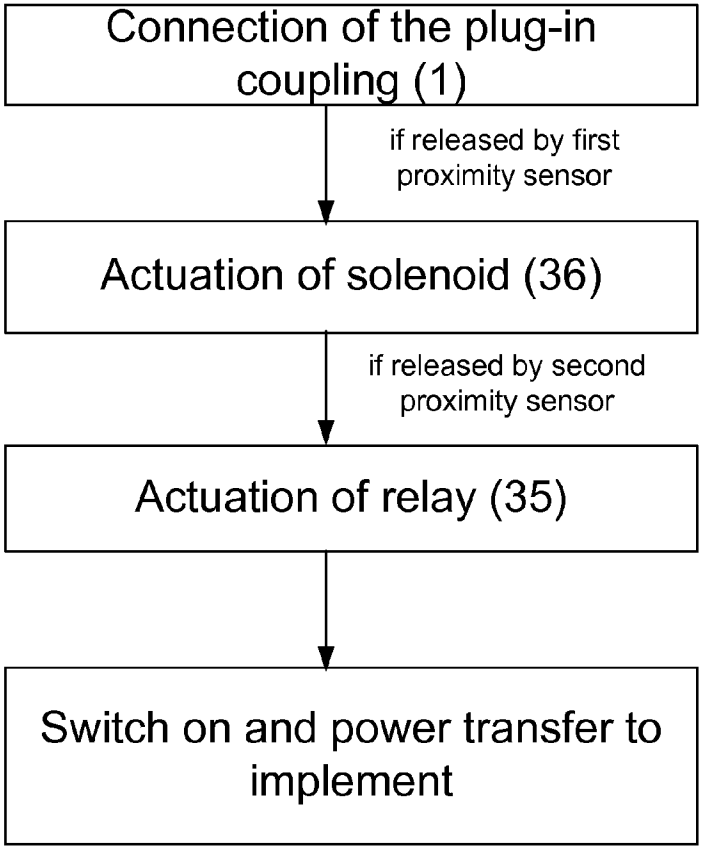
Figure 13A:
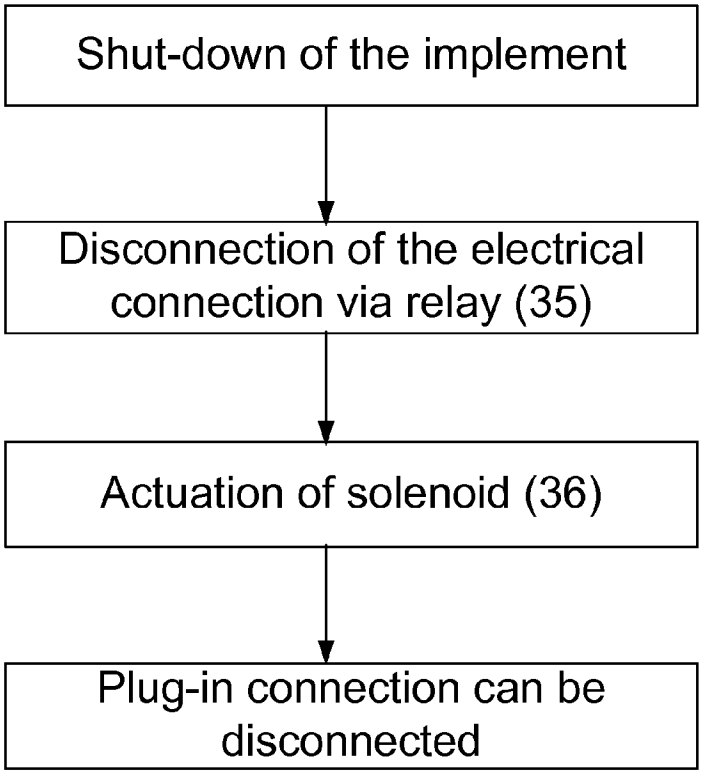

FIG. 13*a*, in a flow diagram, shows exemplarily the single process steps for disconnecting the plug-in coupling 1. Prior to disconnecting the plug-in coupling 1 first the implement connected by means of the plug-in coupling 1 with the utility vehicle is shut down, so that the flow of electric current through the plug-in coupling 1 can be stopped. Afterwards the relay 35 is controlled via the bus system so that the two pins 23 of one coupler socket 3, 3' are electrically disconnected from each other.

Preferably one relay 35 is provided for each coupler socket 3, 3'. The solenoid 36 is controlled via the bus system so that the locking pin 36.1 is pulled out of the bore hole 41. These steps can be carried out by an operator one after or the other or, preferably by a fully automatic process controller, so that the steps can be initiated by means of only a single command, for example "Disconnect implement". Afterwards the plug-in coupling 1 can be disconnected by actuating the crescent lever 33 and the coupler plugs 2, 2' can be pulled out of the coupler sockets 3, 3'.

FIG. 13*b*, in a flow diagram, shows exemplarily the process steps for connecting the plug-in coupling 1. First the coupler plugs 2, 2' are inserted into the coupler sockets 3, 3' and the crescent lever 33 is swiveled into the locking position shown in FIG. 12.

Upon release by the proximity sensor, i.e. the coupler plugs 2, 2' are inserted into the coupler sockets 3, 3', the solenoid 36 is controlled in the manner that the locking pin 36.1 submerges into the bore hole 41. After locking, the proximity sensor signals a release, which triggers the actuation of the relay 35, producing an electrical connection between the second and third inner conductor elements 5.2, 5.3 through the pins 23 connected with each other by means of the relay.

The described steps can again be carried out separately or triggered by means of a single command. After completion of these steps, the mounted implement can be switched on to enable the transfer of power to the same.

The invention was described above based on an exemplary embodiment. It goes without saying that numerous modifications and variations of the invention are possible without abandoning the underlying inventive idea.

REFERENCE LIST

1 Plug-in coupling system
2, 2' coupler plug
2.1, 2.1' first coupler plug end
2.2 coupler plug housing
2.3 second coupler plug end
2.4 end face
2.5 gradation
2.6 gradation
2.7 flange
3, 3' coupler socket
3.1, 3.1' first coupler socket end
3.2 coupler socket housing
3.2.1 inner side
3.2.2 groove
3.2.3 gradation
3.2.4 flange
3.3 second coupler socket end
4 inner conductor
4.1 end side
4.2 free end
5 inner conductor
5.1 first inner conductor element
5.1.1 top area
5.1.2 inner conductor area
5.2 second inner conductor element
5.3 third inner conductor element
5.3.1 free end
6 fluid channel
7 valve body
7.1 groove
8 valve body
8.1 first gradation
8.2 second gradation
8.3 sub-section
8.4 sub-section
8.5 first inner side area
8.6 second inner side area
8.7 gradation
8.8 end face
10 ceramic pin
11 contact sleeve
12 contact sleeve
12.1 inner side of contact sleeve
13 spring contact
14 spring
15 spring
16 seal
17 insulating body
18 insulating body
19 insulating body
21 insulating disk
22 insulating disk
23 pin
24 inner thread
25 reducing sleeve
25.1 free end
25.2 free end
26 insulating disk
27 insulating body
28 coupler plug plate
29 coupler socket plate
30 centering pin
31 troche
32 flange sleeve
33 crescent lever
33.1 grip
33.2, 33.2' crescent lever half
33.3, 33.3' recesses
34 pin
35 relay
36 solenoid
36.1 locking pin
37 protective sheath
38 sheathed cable
39 electronics box
40 connection
41 bore hole
a ring thickness
b diameter
c outer diameter
d diameter
t plug-in depth
DA rotation axis
LA1, LA1' longitudinal axis
LA2, LA2' longitudinal axis
QA transverse axis
T tangent

The invention claimed is:

1. Plug-in coupling system for the transfer of high-power energy and for the transfer of a fluid under pressure, comprising:

at least one coupler plug (2, 2') and at least one coupler socket (3, 3') with at least one electrical conductor (4, 5), respectively, in which the coupler plug (2, 2') can be introduced into the coupler socket (3, 3') to produce a coupled state and can be removed from the coupler socket (3, 3') to produce a decoupled state, characterized in that the plug-in coupling system comprises at least one electromechanical protection system consisting of at least one electronic switch means (35) and at least one mechanical switch means (4, 11), arranged inside the coupler socket (3), the coupler plug (2), or inside both the coupler socket (3) and the coupler plug (2), said mechanical switch means establishing or separating an electroconductive connection, the electronic switch means (35) and the mechanical switch means (4, 11) being independently controllable, characterized in that the coupler plug (2, 2') and the coupler socket (3, 3') each comprises an inner conductor (4, 5) surrounded by a fluid channel (6).

2. The plug-in coupling system according to claim 1, characterized in that the at least one electronic switch means consists of a relay (35).

3. The plug-in coupling system according to claim 1, characterized in that the at least one electronic switch means consists of an electronic circuit comprising at least one electronic high-power component.

4. The plug-in coupling system according to claim 1, characterized in that the at least one mechanical switch means (4, 11) can be switched for establishing or separating the electrically conductive connection by introducing the coupler plug (2, 2') into the coupler socket (3, 3') or by removing the coupler plug (2, 2') from the coupler socket (3, 3').

5. The plug-in coupling system according to claim 1, characterized in that the inner conductors (4, 5) of the coupler plug (2, 2') and the coupler socket (3, 3') are at least partially surrounded by an electrically conductive contact sleeve (11, 12).

6. The plug-in coupling system according to claim 5, characterized in that the electrically conductive contact sleeve (11) is embodied movably relative to the inner conductor (5) of the coupler socket (3, 3').

7. The plug-in coupling system according to claim 5, characterized in that the inner conductor (4) of the coupler plug (2, 2') is embodied movably relative to the electrically conductive contact sleeve (12) of the coupler plug (2, 2').

8. The plug-in coupling system according to claim 7, characterized in that the contact sleeve (12) of the coupler plug (2, 2') electroconductively connects the inner conductors (4, 5) of the coupler plug (2, 2') and the coupler socket (3, 3') in the coupled state.

9. The plug-in coupling system according to claim 8, characterized in that the inner conductor (5) of the coupler socket (3, 3') is embodied as having several parts.

10. The plug-in coupling system according to claim 9, characterized in that the inner conductor (5) of the coupler socket (3, 3') comprises at least two inner conductor elements (5.1, 5.2, 5.3) that are connected with each other in an electrically insulated manner.

11. The plug-in coupling system according to claim 10, characterized in that the at least two inner conductor elements (5.1, 5.2) are connected with each other by a ceramic pin (10).

12. The plug-in coupling system according to claim 11, characterized in that the at least two inner conductor elements (5.1, 5.2) of the coupler socket (3, 3') can be electroconductively connected by the electrically conductive contact sleeve (11) of the coupler plug (2, 2') in the coupled state.

13. The plug-in coupling system according to claim 12, characterized in that the electrically conductive connection between the inner conductor (4, 5) of the coupler plug (2, 2') and the coupler socket (3, 3') and the contact sleeve (11, 12) of the coupler plug (2, 2') and the coupler socket (3, 3') can be produced by means of at least one ring-shaped spring contact (13).

14. The plug-in coupling system according to claim 13 characterized by a fully circumferential coupler plug housing (2.2) and a coupler socket housing (3.2) of electrically conductive material.

15. The plug-in coupling system according to claim 14, characterized in that when the connection between the coupler plug (2, 2') and the coupler socket (3, 3') is disconnected, the inner conductors (4, 5) of the coupler plug (2, 2') and of the coupler socket (3, 3') are short circuited to the coupler plug housing (2.2) or the coupler socket housing (3.2).

16. The plug-in coupling according to claim 15, characterized in that in the coupled state, the coupler plug housing (2.2) and the coupler socket housing (3.2) are connected in an electrically conductive manner and form the chassis ground.

17. The plug-in coupling system according to claim 16, characterized in that a locking mechanism for insertion and fixing of the at least one coupler plug (2, 2') is provided in the at least one coupler socket (3, 3').

18. The plug-in coupling system according to claim 17, characterized in that the locking mechanism consists of a lever or a gear.

19. The plug-in coupling system according to claim 18, further comprising:

the locking mechanism is securely electronically, mechanically, or both electronically and mechanically against improper actuation;

the securing is achieved by an electrically controllable solenoid (36);

at least one proximity sensor is provided for detecting the coupled, the decoupled state, or both the coupled and the decoupled state;

at least one sensor is provided for detecting the state of the solenoid (36);

a Controlled Area Network (CAN) bus system, is provided for control, monitoring, or both control and monitoring of the plug-in coupling system, wherein the bus system is the CAN bus system; and, an electric load capacity of up to 300 kW at an electric current of up to 400 A, wherein in that the at least one electronic switch means consists of an electronic circuit comprising at least one high-power transistor.

20. Plug-in coupling system for the transfer of high-power energy and for the transfer of a fluid under pressure, comprising:

at least one coupler plug (2, 2') and at least one coupler socket (3, 3') with at least one electrical conductor (4, 5), respectively, in which the coupler plug (2, 2') can be introduced into the coupler socket (3, 3') to produce a coupled state and can be removed from the coupler socket (3, 3') to produce a decoupled state, characterized in that the plug-in coupling system comprises at least one electromechanical protection system consisting of at least one electronic switch means (35) and at least one mechanical switch means (4, 11), arranged inside the coupler socket (3), the coupler plug (2), or inside both the coupler socket (3) and the coupler plug (2), said mechanical switch means establishing or separating an electroconductive connection, the electronic switch means (35) and the mechanical switch means (4, 11) being independently controllable, characterized in that the coupler plug (2, 2') and the coupler socket (3, 3') each comprises an inner conductor (4, 5) surrounded by a fluid channel (6), characterized in that the inner conductors (4, 5) of the coupler plug (2, 2') and the coupler socket (3, 3') are surrounded at least to some extent by an electrically conductive contact sleeve (11, 12), characterized in that the electrically conductive contact sleeve (11) of the coupler plug (2, 2') is embodied movably relative to the inner conductor (5) of the coupler socket (3, 3'), characterized in that the inner conductor (4) of the coupler plug (2, 2') is embodied movably relative to the electrically conductive contact sleeve (12) of the coupler plug (2, 2'), characterized in that the contact sleeve (12) of the coupler plug (2, 2') electroconductively connects the inner conductors (4, 5) of the coupler plug (2, 2') and the coupler socket (3, 3') in the coupled state, characterized in that the inner conductor (5) of the coupler socket (3, 3') is embodied as having several parts, characterized in that the inner conductor (5) of the coupler socket (3, 3') comprises at least two inner conductor elements (5.1, 5.2, 5.3) that are connected with each other in an electrically insulated manner, characterized in that the at least two inner conductor elements (5.1, 5.2) are connected with each other by a ceramic pin (10), characterized in that the at least two inner conductor elements (5.1, 5.2) of the coupler socket (3, 3') can be electroconductively connected by a contact sleeve (11) of the coupler plug (2, 2') in the coupled state, characterized in that the electrically conductive connection between the inner conductor (4, 5) and the contact sleeve (11, 12) can be produced by means of at least one ring-shaped spring contact (13), characterized by a fully circumferential coupler plug housing (2, 2) and a coupler socket housing (3.2) of electrically conductive material, characterized in that when the connection between the coupler plug (2, 2') and the coupler socket (3, 3') is disconnected the inner conductors (4, 5) of the coupler plug (2, 2') and of the coupler socket (3, 3') are short circuited to the coupler plug housing (2.2) or the coupler socket housing (3.2), characterized in that in the coupled state the coupler plug housing (2.2) and the coupler socket housing (3.2) are connected in an electrically conductive manner and form the chassis ground, characterized in that a locking mechanism for insertion and fixing of the at least one coupler plug (2, 2') is provided in the at least one coupler socket (3, 3'), characterized in that the locking mechanism consists of a crescent lever (33) or a gear, characterized in that the locking mechanism is securely electronically, mechanically, or both electronically and mechanically against improper actuation, the securing is achieved by an electrically controllable solenoid (36), at least one proximity sensor is provided for detecting the coupled, the decoupled state, or both the coupled and the decoupled state, at least one sensor is provided for detecting the state of the solenoid (36), a Controlled Area Network (CAN) bus system, is provided for control, monitoring, or both control and monitoring of the plug-in coupling system, wherein the bus system is the CAN bus system, and an electric load capacity of up to 300 kW at an electric current of up to 400 A.

* * * * *